US008267390B2

(12) United States Patent
Dellach

(10) Patent No.: US 8,267,390 B2
(45) Date of Patent: Sep. 18, 2012

(54) LOCKING MECHANISM AND RECONFIGURABLE CLAMP INCORPORATING THE SAME

(75) Inventor: Jeff Dellach, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 792 days.

(21) Appl. No.: 12/137,173

(22) Filed: Jun. 11, 2008

(65) Prior Publication Data

US 2009/0309284 A1 Dec. 17, 2009

(51) Int. Cl.
*B25B 1/24* (2006.01)

(52) U.S. Cl. ..... 269/266; 269/256; 269/265

(58) Field of Classification Search ..... 269/256, 269/265, 266

See application file for complete search history.

(56) References Cited

U.S. PATENT DOCUMENTS

| | | | | |
|---|---|---|---|---|
| 2,754,708 | A | 7/1956 | Peterson | |
| 2,790,361 | A * | 4/1957 | Swanson et al. | 269/20 |
| 5,224,586 | A | 7/1993 | Naka et al. | |
| 5,622,090 | A | 4/1997 | Marks | |
| 6,799,757 | B1 | 10/2004 | Lang | |
| 7,125,010 | B2 | 10/2006 | Moore et al. | |
| 7,364,147 | B2 | 4/2008 | Shinozaki | |
| 7,726,637 | B2 * | 6/2010 | Stevenson et al. | 269/266 |
| 2006/0244190 | A1 | 11/2006 | Erdmann | |

* cited by examiner

*Primary Examiner* — Lee D Wilson
*Assistant Examiner* — Shantese McDonald
(74) *Attorney, Agent, or Firm* — Quinn Law Group, PLLC

(57) ABSTRACT

A selectively lockable assembly includes a body, a pin, a locking member, and a plunger that is configured to selectively urge the locking member against the pin to lock the pin with respect to the body. The locking member is keyed to the body in a manner to prevent or limit rotation of the locking member and thereby limit movement of the pin under load. A corresponding clamp is also provided.

11 Claims, 4 Drawing Sheets

LOCKING MECHANISM AND RECONFIGURABLE CLAMP INCORPORATING THE SAME

TECHNICAL FIELD

This invention relates to locking mechanisms and reconfigurable clamps incorporating locking mechanisms.

BACKGROUND OF THE INVENTION

Clamps are used extensively to temporarily locate sheet metal parts during the fabrication of sheet metal parts, usually by spot welding, into vehicle bodies or body subassemblies. Clamps are typically specific to one vehicle body style and to one location on that body style. Thus due to variations in external sheet metal, the same clamp cannot be used on a broad range of vehicle bodies even when general similarities exist between them. Thus the number of vehicle body variants which can be fabricated on a particular body assembly line is restricted.

SUMMARY OF THE INVENTION

A selectively lockable assembly includes a body, a pin that is selectively movable with respect to the body, an actuator member that is selectively movable in first and second directions with respect to the body, and a locking member that is operatively connected to the body such that the body restricts rotation of the locking member in at least one direction. The actuator member is configured to urge the locking member against the pin when the actuator member is urged in one of the first and second directions. The locking member being urged against the pin locks the pin with respect to the body. The selectively lockable assembly improves upon prior art lockable assemblies by preventing rolling of the locking member with respect to the body and the pin, thereby enhancing the fastening of the pin with respect to the body.

A reconfigurable clamp is also provided. The clamp includes a body, a plurality of pins that are operatively connected to the body and that are selectively movable with respect to the body, an actuator member that is operatively connected to the body and that is selectively movable with respect to the body in first and second directions, and a locking member. The locking member is operatively connected to the body such that the body restricts rotation of the locking member in at least one direction. The actuator member is configured to urge the locking member against at least one of the pins when the actuator member is urged in one of the first and second directions.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 2:
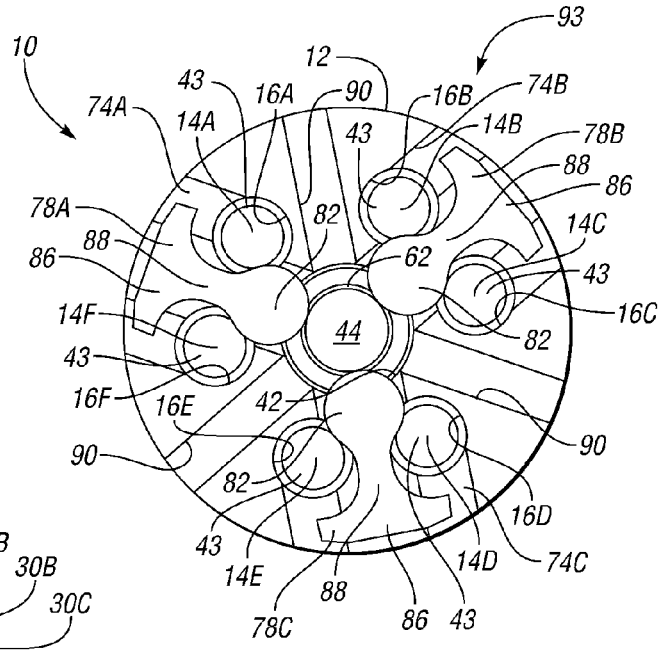
FIG. 2 is a schematic, cross-sectional bottom view of the clamp assembly of FIG. 1.
Figure 1:
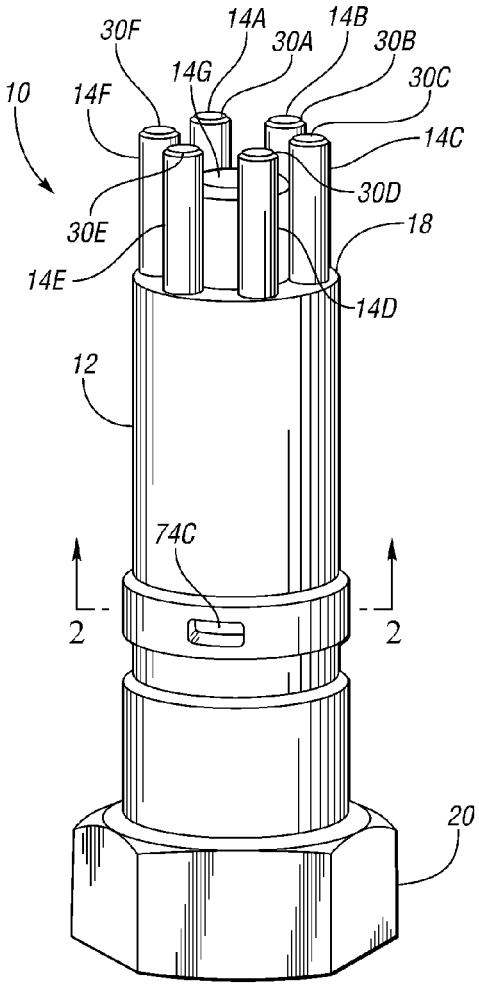
FIG. 1 is a schematic, perspective view of a clamp assembly having a plurality of pins.

Referring to FIGS. 1 and 2, a reconfigurable clamp 10 is schematically depicted. The clamp 10 includes a body 12, which, in the embodiment depicted, is generally cylindrical, but which may be characterized by other shapes within the scope of the claimed invention. The clamp 10 also includes a plurality of pins 14A-F that are selectively movable with respect to the body 12. The clamp 10 also includes a pin 14G that is fixed with respect to the body 12. The body 12 defines a plurality of elongated holes 16A-F, each of which at least partially contains a respective one of the pins 14A-F.

Figure 3:
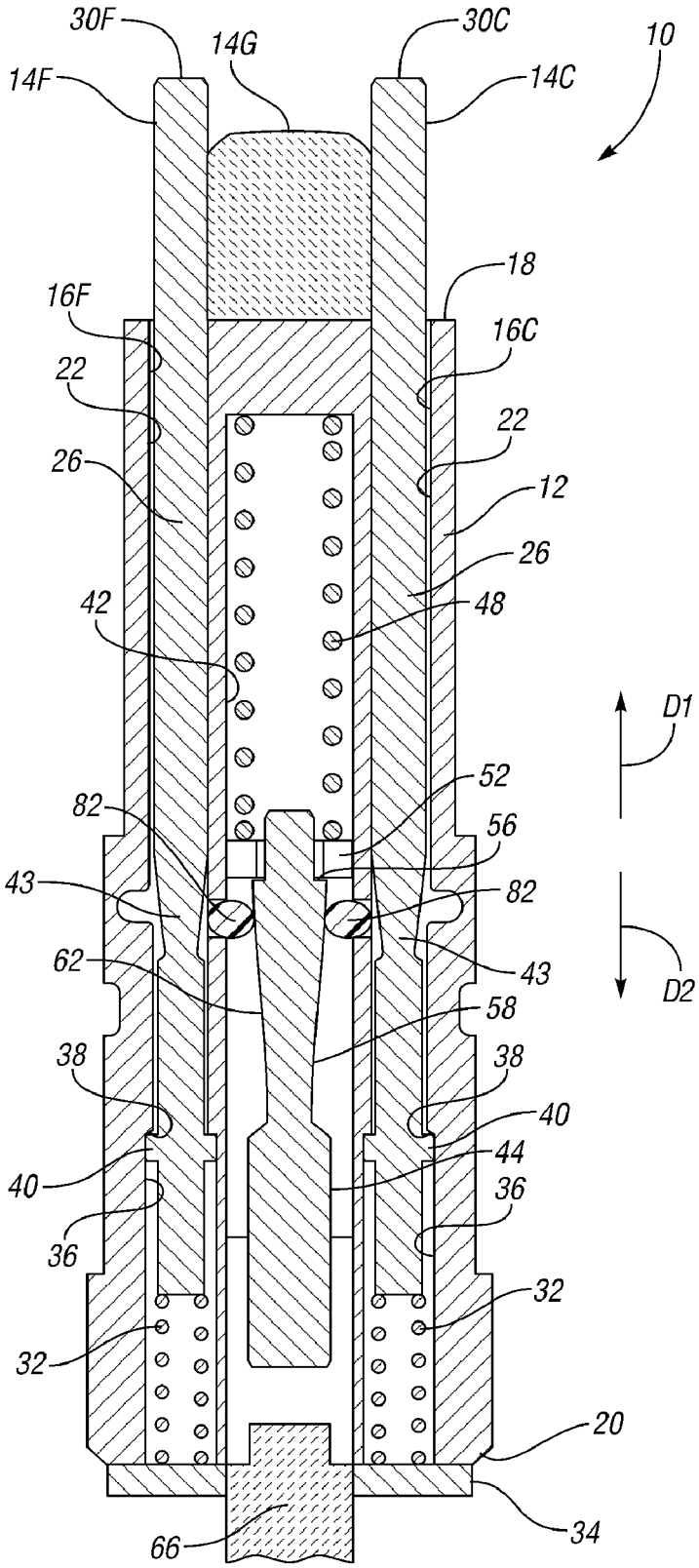
FIG. 3 is a schematic, cross-sectional side view of the clamp assembly of FIG. 1.

FIG. 3 is a schematic, cross-sectional view of the clamp 10, which depicts pins 14C, 14F and holes 16C, 16F. It should be noted that pins 14C, 14F are representative of all of the movable pins 14A-F, and that holes 16C, 16F are representative of all of holes 16A-F. The holes 16C, 16F extend through the body 12 from the tip 18 of the body 12 to the base 20 of the body 12. In the embodiment depicted, the pins 14C, 14F are generally cylindrical. The holes 16C, 16F are generally cylindrical. Each hole 16C, 16F is characterized by a respective segment 22 that has a uniform diameter. Each pin 14C, 14F is characterized by a respective segment 26 that has a uniform diameter and that is positioned within a respective one of segments 22. The diameter of segments 22 is slightly larger than the diameter of segments 26 so that the surfaces defining segments 22 restrict the movement of the pins 14C, 14F to substantially linear translation in either a first direction D1 or a second direction D2, which is opposite the first direction D1. As used herein, directions D1 and D2 are relative to the clamp 10. Each pin 14A-F is capable of individual motion in the first or second direction without inducing motion in any of the other pins 14A-F.

Referring again to FIG. 1, each pin 14A-F includes a respective end, or tip 30A-F. Each of the pins 14A-F in FIG. 1 is depicted in a respective extended position in which the tip of each pin is a predetermined distance outside the holes 16A-F and from the tip 18 of the body 12. Referring again to FIG. 3, a spring 32 is positioned within hole 16C between a base plate 34 and pin 14C and urges the pin 14C in the first direction D1 to its extended position. Similarly, a spring 32 is positioned within hole 16F between base plate 34 and pin 14F and urges the pin 14F in the first direction D1 to its extended position. Springs (not shown) identical to the springs shown at 32 are also in holes 16A, 16B, 16D, 16E between the base plate 34 and a respective one of pins 14A, 14B, 14D, 14E to bias the pins 14A, 14B, 14D, 14E in their respective extended positions.

Hole 16C includes a section 36 having a diameter greater than the diameter of section 22. A lip 38 is formed in the body 12 where segment 22 and segment 36 meet. Pin 14C includes a wide section 40 that has a diameter greater than the diameter of section 22, but less than the diameter of section 36. Section 40 of pin 14C is within section 36 of hole 16C. Thus, section 36 of hole 16C is wide enough to accommodate translation of section 40 therein. However, the lip 38 and the section 40 are sufficiently positioned to contact each other when the pin 14C is in its extended position. Thus, the physical part interference between section 40 and the lip 38 prevents movement of the pin 14C in the first direction D1 beyond the extended position. Each pin 14A-F also includes a respective tapered portion 43, which, in the embodiment depicted, decreases in diameter in the second direction D2.

The body 12 also defines a central hole 42, which, in the embodiment depicted, is cylindrical and has a common centerline with the body 12. In the embodiment depicted, the pins 14A-F and holes 16A-F are equidistant from the hole 42 and thus are arranged about a circle having the hole 42 at its center. An actuator member 44 is located within the central hole 42. The actuator member 44 is a plunger that is selectively movable in the first and second directions D1, D2. A spring 48 urges the actuator member 44 in the second direction D2. More specifically, the spring 48 is within the hole 42 between a closed end of the hole 42 and a collar 52, and urges the collar 52 in the second direction D2. The collar 52 acts on a lip 56 formed on the actuator member 44 and thereby transfers the force of the spring 48 to the actuator member 44.

The actuator member 44 is characterized by a tapered portion 58 that decreases in diameter in the second direction D2. The tapered portion 58 in the embodiment depicted is frustoconical, i.e., has the shape of a frustum of a cone. The tapered portion is characterized by outer surface 62.

The clamp 10 further includes a member 66 that is configured to selectively contact the actuator member 44 and to cause the actuator member 44 to move in the first direction D1, against the force of spring 48. In the embodiment depicted, member 66 is operatively connected to a pneumatic actuator, as shown at 70 in FIG. 5. Other devices or techniques of moving actuator member 44 may be employed within the scope of the claimed invention. For example, the clamp 10 may include a servomotor or solenoid to move the actuator member 44, the actuator member 44 may be manually moved (such as via a mechanical linkage), etc.

Referring again to FIG. 2, the body 12 defines three lateral apertures, or holes 74A, 74B, 74C, each of which extends laterally from the outer surface of the clamp body 12 to the central hole 42. Each of the lateral holes 74A, 74B, 74C is also open to a respective two of the holes 16A-F such that two of the pins 14A-F are accessible from one of the lateral holes 74A, 74B, 74C. Thus, each hole 74A, 74B, 74C interconnects the central hole 42 and a two of the holes 16A-F.

More particularly, in the embodiment depicted, at least a portion of each of the of the lateral holes 74A, 74B, 74C is coextensive with a portion of two of the holes 16A-F. Portions of hole 74A are coextensive with portions of holes 16A and 16F. Portions of hole 74B are coextensive with portions of holes 16B and 16C. Portions of hole 74C are coextensive with holes 16D and 16E.

Figure 4:
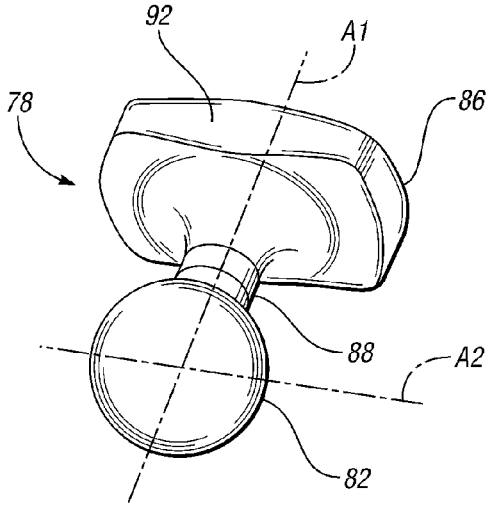
FIG. 4 is a schematic, perspective view of a locking element in the clamp assembly of FIG. 1.

The clamp 10 also includes three locking members 78A, 78B, 78C. Each of the locking members 78A, 78B, 78C is at least partially located within a respective one of the holes 74A, 74B, 74C. Referring to FIG. 4, locking member 78 is representative of locking members 78A, 78B, 78C. Locking member 78 includes a substantially spherical portion 82 and a generally polygonal portion 86. In the embodiment depicted, the generally polygonal portion 86 has a form approximating that of a rectangular parallelepiped. The spherical portion 82 and the polygonal portion 86 are interconnected by a cylindrical or rod-like portion 88, one end of which terminates on the surface of the spherical portion 82 while the other end terminates on one face of the polygonal portion 86. As shown in FIG. 4, the portions 86, 88 may exhibit features such as chamfers and rounded corners to enable a smoother transition and blending of their individual geometries.

Referring again to FIG. 2, portion 82 of member 78A is between actuator member 44 and pins 14A, 14F such that portion 82 of member 78A contacts surface 62 of the actuator member 44 and the tapered portions 43 of pins 14A, 14F. Portion 88 of member 78A is between pins 14A, 14F. Portion 86 of member 78A is in hole 78A such that the movement of member 78A is restricted, as will be explained in more detail. Portion 82 of member 78B is between actuator member 44 and pins 14B, 14C such that portion 82 of member 78B contacts surface 62 of the actuator member 44 and the tapered portions 43 of pins 14B, 14C. Portion 88 of member 78B is between pins 14B, 14C. Portion 86 of member 78B is in hole 74B such that the movement of member 78B is restricted. Portion 82 of member 78C is between actuator member 44 and pins 14D, 14E such that portion 82 of member 78C contacts surface 62 of the actuator member 44 and the tapered portions 43 of pins 14D, 14E. Portion 88 of member 78C is between pins 14D, 14E. Portion 86 of member 78C is in hole 74C such that the movement of member 78C is restricted.

In the embodiment depicted, the body 12 of the clamp 10 also defines holes 90. Each hole 90 is opposite a respective one of holes 74A-C, and may facilitate maintenance of the clamp 10 by providing access to the locking members 78A-C.

Figure 5:
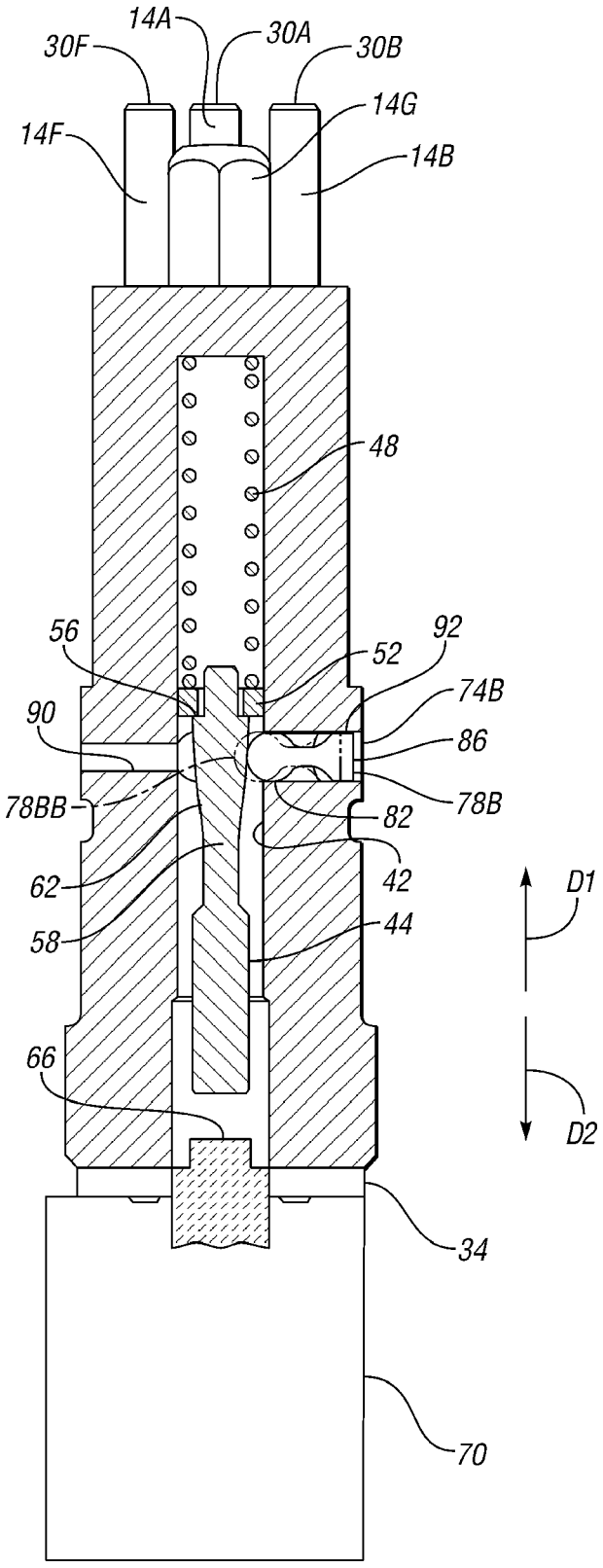
FIG. 5 is a schematic, sectional side view of the clamp assembly of FIG. 1.

Referring to FIG. 5, hole 74B and locking element 78B are schematically depicted. Hole 74B is representative of holes 74A, 74C. Locking element 78B is representative of locking elements 78A, 78C. The locking member 78B and the hole 74B are configured such that interaction between the body 12 and the locking member 78B prevents rotation of the locking member 78B with respect to the body 12 in at least two directions.

Referring to FIGS. 4 and 5, the polygonal portion 86 functions as a polygonal key, interacting with the body 12 inside hole 74B to prevent rotation of the member 78B about axis A1. That is, the perimeter 92 of the polygonal portion 86 interacts with the surface of the body 12 that defines the hole 74B such that the body 12 prevents the rotation of the locking member 78B about axis A1. A portion of the spherical portion 82 protrudes outward from the lateral hole 74B into the central hole 42 to contact surface 62 of the actuator member 44. Another portion of the spherical portion 82 remains in the lateral hole 74B. The height of the lateral hole 74 is only marginally larger than the diameter of the spherical portion 82 and the height of the polygonal portion 86; thus the surface of the body 12 that defines the hole 74B also prevents rotation of the locking member 78B about axis A2. Axes A1 and A2 are perpendicular to each other and are perpendicular to the first and second directions D1, D2. The surfaces of the body 12 that define hole 74B also prevent movement of the locking member 78B in either the first direction D1 or the second direction D2.

Referring again to FIGS. 2, 3, and 5, the spring 48 exerts a force on the actuator member 44 in the second direction via the collar 52. The surface 62 of the actuator member 44 is angled relative to the second direction D2 such that the actuator member 44 transfers the force from the spring 48 to the spherical portions 82 of the locking members 78A-C. The force exerted on the spherical portions 82 by the surface 62 includes a lateral component, i.e., a component that is orthogonal to the first and second directions D1, D2, and that urges the spherical portions 82 away from the central hole 42 and into the tapered portions 43 of the pins 14A-F, thereby locking the pins 14A-F with respect to the body 12. Thus, the actuator member 44 and the locking members 78A-C are part of a locking mechanism 93 that selectively prevents movement of the pins 14A-F relative to the body. Each locking member 78A, 78B is prevented from rotating about an axis that is parallel to the first and second directions D1, D2 by the surface 62 and two of the pins 14A-F acting thereon. Thus, in the embodiment depicted, the locking members 78A-C are prevented from rotating, and their movement is limited to lateral translation.

Figure 6:
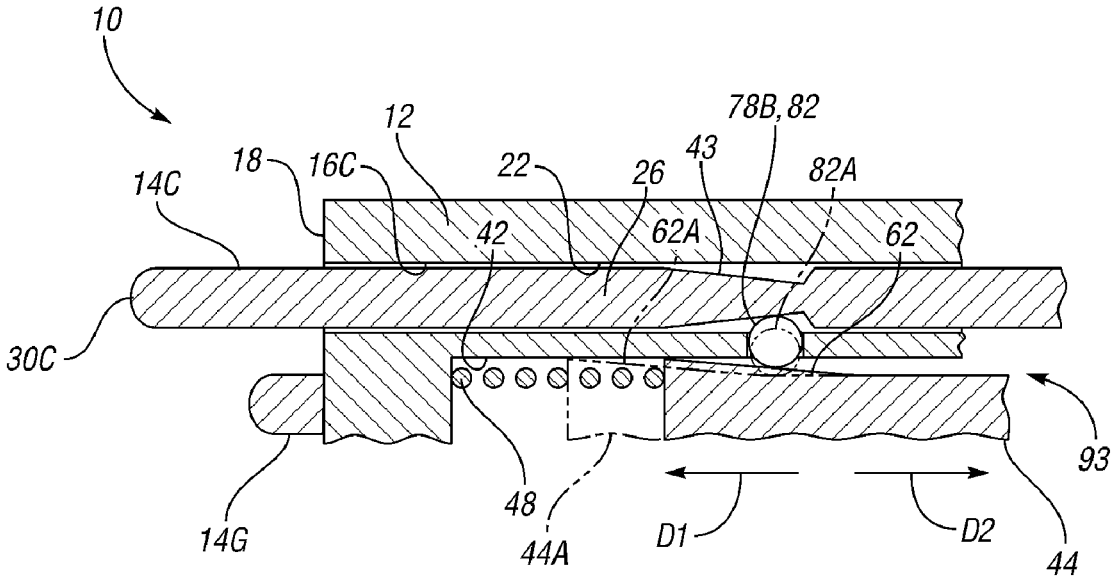
FIG. 6 is a schematic, fragmentary sectional view of the clamp assembly of FIG. 1 with one of the pins in a first position.
Figure 7:
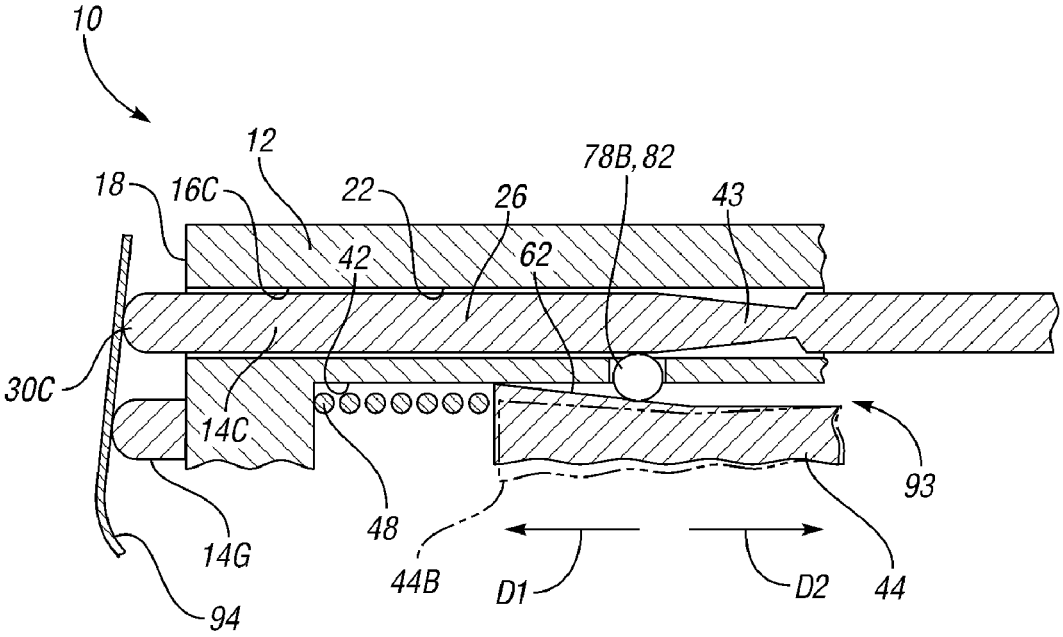
FIG. 7 is a schematic, fragmentary sectional view of the clamp assembly of FIG. 1 with the pin of FIG. 6 in a second position.

The clamp 10 is reconfigurable; that is, the locking mechanism 93 is selectively releasable so that the positions of the pins 14A-F with respect to the body 12 are selectively variable. FIGS. 6 and 7 schematically depict operation of the locking mechanism 93 during reconfiguration of the clamp 10, i.e., during repositioning of the pins with respect to the clamp body 12. Although only pin 14C is shown in FIGS. 6 and 7, it should be noted that the interaction between pin 14C and the locking mechanism 93 is identical to the interaction between the other selectively movable pins 14A-B, 14D-F and the locking mechanism 93.

Referring to FIG. 6, pin 14C is shown in its extended position. Spring 48 urges actuator member 44 in the second direction D2; in turn, surface 62 of the actuator member 44 drives spherical portion 82 of locking member 78B outward and against the tapered portion 43 of pin 14C, thereby locking pin 14C with respect to the body 12. Friction between the spherical portion 82 of the locking member 78B and the pin 14C prevents movement of the pin 14C in the first direction D1. It should be noted that, in the embodiment depicted, the force exerted by the spring (shown at 32 in FIG. 3) is sufficient to overcome friction between the pin 14C and the body 12, but is not sufficient to overcome the friction between the locking element 78B and the pin 14C.

The pin 14C is prevented from moving in the second direction D2 due to friction between the locking member 78B and the pin 14C, and also because the tapered portion 43 is angled relative to the second direction D2 such that movement of the pin 14C in the second direction causes the locking member 78B to exert a reaction force on the pin 14C in the first direction.

It should be noted that, if spherical balls are used in place of locking elements 78A-C, then the balls could rotate, or "roll," relative to the body and to the pins, and thus the pins may "drift" from their intended positions. The locking members 78A-C, by being keyed to the body 12, are prevented from rolling in a direction that would compromise the ability to lock the pins 14A-F with respect to the body 12.

To unlock the pin 14C, and thereby to permit translation of the pin 14C in either the first or the second direction D1, D2, the actuator member 44 is moved in the first direction D1. More specifically, in the embodiment depicted, the actuator (shown at 70 in FIG. 5) exerts a force on member 66 (shown in FIGS. 3 and 5), which transmits the force to the actuator member 44. The force exerted by the actuator 70 is sufficient to overcome the bias of the spring 48, and the actuator member 44 moves in the first direction to the position shown in phantom at 44A. Correspondingly, surface 62 moves in the first direction D1 to the position shown in phantom at 62A.

The taper of surface 62 is such that movement of the actuator member 44 in the first direction D1 increases the distance between surface 62 and the tapered portion 43, and thus the spherical portion 82 of the locking member 78B. Thus, locking member 78B is not tightly wedged between the surface 62 and the tapered portion 43 of the pin, thereby permitting relative movement of the pin 14C relative to the body 12. Thus, when the surface is at the position shown at 62A, the locking member 78B can move laterally, away from the pin 14C (and pin 14B) to the position shown in phantom at 78BB in FIG. 5; correspondingly, the spherical portion 82 of the locking member 78B moves laterally, further into the central hole 42, to the position shown in phantom at 82A in FIG. 6, where it does not contact the pin 14C, or, if contact occurs between the spherical portion 82 and the pin 14C, the friction therebetween is low.

Thus, movement of the member 44 to the position shown at 44A unlocks the pin 14C with respect to the body 12, and the pin 14C is selectively movable. In an exemplary use, the clamp 10 is employed by a robotic arm or other fixture to manipulate or hold sheet metal components for vehicle bodies. In prior art systems, a robotic arm or other fixture would require a new clamp, or significant machining of a clamp, to handle sheet metal components having different shapes or contours. The clamp 10 is reconfigurable such that the clamp 10 can be used for sheet metal components of differing contours and shapes.

Referring to FIG. 7, to reconfigure the clamp 10 for a particular sheet metal contour, a representative piece of sheet metal 94 is pressed against the tips 30A-F of the pins 14A-F when the pins 14A-F are unlocked, i.e., when the actuator member 44 is in the position shown at 44A in FIG. 6. The axis of advance of the sheet metal part 94 should be such as to locate the point of contact between the fixed pin 14G and the sheet metal part 94 at a predetermined location on the sheet metal part 94, which is preferably a location of minimal local curvature. The sheet metal part 94 will continue to contact and displace the pins 14A-F until the sheet metal part 94 contacts the fixed pin 14G and the relative motion between the sheet metal part 94 and the clamp body 12 ceases. Preferably at the point when contact occurs between the sheet metal part 94 and the fixed pin 14G, the sheet metal part 94 will contact all of the plurality of movable pins 14A-F.

The sheet metal 94 will move each pin 14A-F in the second direction D2, against the bias of the springs shown at 32 in FIG. 3, to a respective position in which the tips 30A-F approximate the contour of the sheet metal 94. Thus, in FIG. 7, pin 14C has been moved in the second direction D2 by the sheet metal 94 from its extended position to the position shown in FIG. 7. It should be noted that the stationary pin 14G is used as a reference location capable of identifying the location of the clamped sheet metal 94 in the reference frame of the tooling and thus for specifying the operating location of the clamp 10.

After the pin 14C has been moved to the position shown in FIG. 7, then the actuator (shown at 70 in FIG. 5) is deactivated, and the spring 48 urges the actuator member 44 in the second direction D2 until the actuator member 44 is in the position shown in FIG. 7 and driving the spherical portion 82 of locking member 78B against pin 14C (and pin 14B), thereby to lock the pins 14C and 14B with respect to the body 12. It should be noted that the locking element 78B in FIG. 7 contacts tapered portion 43 at a wider portion of the tapered portion 43 in FIG. 7 than in FIG. 6; accordingly, the locking element 78B is closer to the centerline of hole 42 in FIG. 7 than in FIG. 6. Thus, once the pneumatic actuator is deactivated and the spring 48 moves the actuator member 44 in the second direction D2, the locking element 78B prevents the actuator member 44 from returning to its original position shown at 44 in FIG. 6. Since all three locking members 78A-C may move laterally as a result of pin movement, the actuator member 44 is movable laterally, such as to the position shown at 44B, in order to find a location such that it acts on all three locking members 78A-C. Thus, the actuating member 44 is not rigidly connected to the collar (shown at 52 in FIG. 3) or to the member (shown at 66 in FIG. 3).

It should be noted that the locked condition is achieved through the urging of actuator spring 48, without the need for any action of the actuator (shown at 70 in FIG. 5). Thus the locking action may be achieved without the application of external power to the reconfigurable clamp 10. Hence the reconfigurable clamp 10 maintains its geometry even in the case of a power failure which incapacitates the external source of power. The locking members 78A-C may be hardened to limit deformation during stress. In an exemplary embodiment, springs (not shown) may be used to bias the locking members 78A-C into contact with surface 62 of the actuator member 44. The springs shown at 32 and 48 are depicted as compression coil springs; however, those skilled in the art will recognize other spring configurations that may be employed within the scope of the claimed invention. In an exemplary embodiment, the springs 32, 48 are plunger springs. Pin 14G is depicted as a member attached to the body 12; however, within the scope of the claimed invention, the pin 14G may be part of the body 12.

In the above description it has been assumed that the transfer of the shape of the sheet metal part 94 to be supported and the clamp 10 is achieved through contact between the sheet metal part 94 and the reconfigurable clamp 10. Alternatively, a solid block into which a representation of the relevant section of the sheet metal part 94 has been rendered may also be used. Such a procedure may be desirable if it is desired to set the form of the reconfigurable clamp 10 off-line and bring it to the operating location with the shape already preset.

In alternative embodiments, and within the scope of the claimed invention, the tapered portions 43 on the movable pins 14A-F may be oriented such that the diameter of the tapered portions 43 increase in the second direction D2, instead of in the first direction D1 as shown. Similarly, and within the scope of the claimed invention, the tapered portion 58 on the actuator member 44 may be oriented such that the diameter of the tapered portion 58 increases in the second direction D2, instead of in the first direction D1 as shown.

While the best modes for carrying out the invention have been described in detail, those familiar with the art to which this invention relates will recognize various alternative designs and embodiments for practicing the invention within the scope of the appended claims.

The invention claimed is:

1. A selectively lockable assembly comprising:

a body;

a pin being selectively movable with respect to the body;

an actuator member being selectively movable in first and second directions with respect to the body;

a locking member having a substantially spherical portion and a nonspherical portion connected to the spherical portion, the locking member being operatively connected to the body such that interaction between the nonspherical portion and the body prevents or limits rotation of the locking member, including the spherical portion, in at least one direction;

wherein the actuator member is configured to urge the locking member against the pin when the actuator member is urged in one of the first and second directions.

2. The selectively lockable assembly of claim 1, wherein the substantially spherical portion is between the actuator member and the pin.

3. The selectively lockable assembly of claim 1, wherein the body defines an aperture; and wherein the nonspherical portion of the locking member is within the aperture.

4. The selectively lockable assembly of claim 3, wherein the nonspherical portion is a polygonal portion.

5. The selectively lockable assembly of claim 1, wherein the actuator member includes a tapered portion having a surface in contact with the locking member.

6. The selectively lockable assembly of claim 1, wherein the pin includes a tapered portion; and wherein the actuator member is configured to urge the locking member against the tapered portion when the actuator member is urged in one of the first and second directions.

7. The selectively lockable assembly of claim 1, wherein the nonspherical portion is rigidly connected to the spherical portion.

8. A selectively reconfigurable clamp comprising:

a body;

a plurality of pins being operatively connected to the body and being selectively movable with respect to the body;

an actuator member being operatively connected to the body and being selectively movable with respect to the body in first and second directions;

a locking member being operatively connected to the body such that the body restricts rotation of the locking member in at least one direction;

wherein the actuator member is configured to urge the locking member against at least one of the pins when the actuator member is urged in one of the first and second directions;

wherein said plurality of pins includes a first pin and a second pin;

wherein the actuator member is configured to urge the locking member against the first pin and the second pin when the actuator member is urged in one of the first and second directions;

wherein the body defines an aperture;

wherein the locking member includes a first portion that is between the actuator member, the first pin, and the second pin;

wherein the locking member includes a second portion that is located within the aperture and is polygonal; and wherein the locking member includes a third portion that interconnects the first portion and the second portion, and that extends between the first pin and the second pin.

9. The clamp of claim 8, wherein the first portion is substantially spherical.

10. The clamp of claim 9, wherein the second portion and the body interact to prevent rotation of the locking member in at least one direction.

11. A reconfigurable clamp assembly comprising:

a body defining a central hole, first, second, third, and fourth holes being arranged around the central hole, a fifth hole interconnecting the first and second holes and the central hole, and a sixth hole interconnecting the third and fourth holes and the central hole;

first, second, third, and fourth pins being at least partially positioned within a respective one of the first, second, third, and fourth holes and being selectively translatable therein with respect to the body;

a first locking member being at least partially within the fifth hole such that the body restricts rotation of the first locking member in at least one direction;

a second locking member being at least partially within the sixth hole such that the body restricts rotation of the second locking member in at least one direction; and an actuator member being within the central hole and selectively movable in first and second directions;

wherein the actuator member is configured to urge the first locking member against the first and second pins and to urge the second locking member against the third and fourth pins when the actuator member is urged in one of the first and second directions.

* * * * *